US006520877B1

(12) United States Patent
Yang

(10) Patent No.: US 6,520,877 B1
(45) Date of Patent: Feb. 18, 2003

(54) BASKETBALL

(75) Inventor: Wei-Chao Yang, Taipei (TW)

(73) Assignee: Conti Tai Young Sporting Goods Co., Taipei (TW)

( * ) Notice: Subject to any disclaimer, the term of this patent is extended or adjusted under 35 U.S.C. 154(b) by 0 days.

(21) Appl. No.: 09/864,897

(22) Filed: May 25, 2001

(51) Int. Cl.[7] ..... A63B 41/08
(52) U.S. Cl. ..... 473/604; 473/597
(58) Field of Search ..... 473/596, 597, 473/599, 604, 605, 609, 613

(56) References Cited

U.S. PATENT DOCUMENTS 3,256,019 A * 6/1966 Barton ..... 473/597
3,475,027 A * 10/1969 Henderson ..... 473/597
3,508,750 A * 4/1970 Henderson ..... 473/605
3,512,777 A * 5/1970 Henderson ..... 473/597
5,681,233 A * 10/1997 Guenther et al. ..... 473/605
6,123,633 A * 9/2000 Guenther et al. ..... 473/604

* cited by examiner

*Primary Examiner*—Steven Wong
(74) *Attorney, Agent, or Firm*—Donald C. Casey, Esq.

(57) ABSTRACT

A basketball constructed to include an inflatable inner tube, a leather cover, a carcass laminated in between the inner tube and the leather cover, and a thread layer bonded between the inner tube and the carcass, the carcass having a plurality of longitudinally grooved partition ribs formed integral with the outer surface thereof, each longitudinally grooved partition rib having protruding grains disposed in flash with protruding grains of the leather cover, the leather cover being formed of multiple panels of leather cover respectively adhered to the carcass and abutted against each of the longitudinally grooved partition ribs.

1 Claim, 2 Drawing Sheets

BASKETBALL

BACKGROUND OF THE INVENTION

The present invention relates to a basketball and, more particularly, to a laminated basketball, which does not slip from the hand when playing.

Regular basketballs include two types, namely, the molded rubber basketballs and the laminated basketballs. A molded rubber basketball is easy and inexpensive to manufacture because it is directly molded from rubber. A laminated basketball is complicated and expensive to manufacture. FIGS. 1 and 2 show a laminated basketball constructed according to the prior art. This structure of laminated basketball is comprised of an inflatable inner tube 11, which is mounted with an air nozzle and then inflated and vulcanized during the fabrication of the laminated basketball, a thread layer 12 wound round the outside wall of the inner tube 11, a carcass 13 adhered to the outside wall of the thread layer 12, the carcass 13 having longitudinally grooved partition ribs 132 raised from the flat outer surface 131 thereof, and panels of leather cover 14 adhered to the flat outer surface 131 of the carcass 13 and respectively abutted against each of the longitudinally grooved partition ribs 132. This structure of laminated basketball is still not satisfactory in function. Because the longitudinally grooved partition ribs 132 have a respective smooth outer surface exposed to the outside, the player cannot positively grasp the basketball with the hand having sweat.

SUMMARY OF THE INVENTION

The invention has been accomplished to provide a laminated basketball, which eliminates the aforesaid problem. It is therefore the main object of the present invention to provide a laminated basketball, which does not slip from the hand when playing. According to the present invention, the longitudinally grooved partition ribs of the carcass each have protruding grains disposed in flush with the protruding grains of the leather cover, which prevent the user from touching

DETAILED DESCRIPTION OF THE PREFERRED EMBODIMENT

Figure 1:
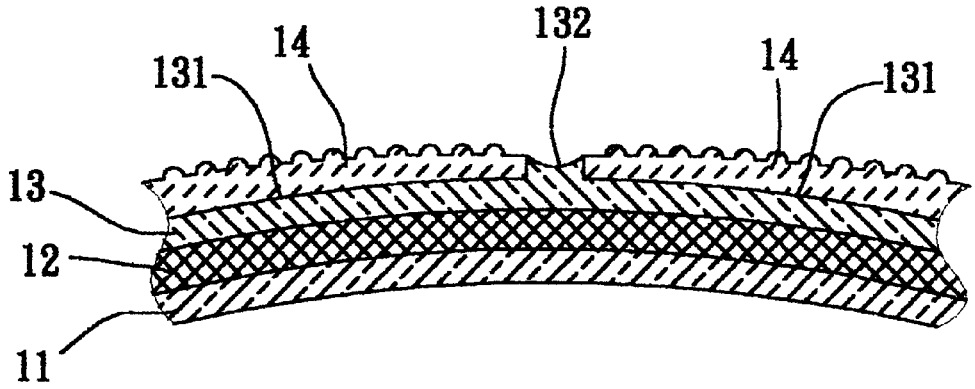
FIG. 1 PRIOR ART
FIG. 1 is a sectional view showing the structure of a laminated basketball according to the prior art.
Figure 3:
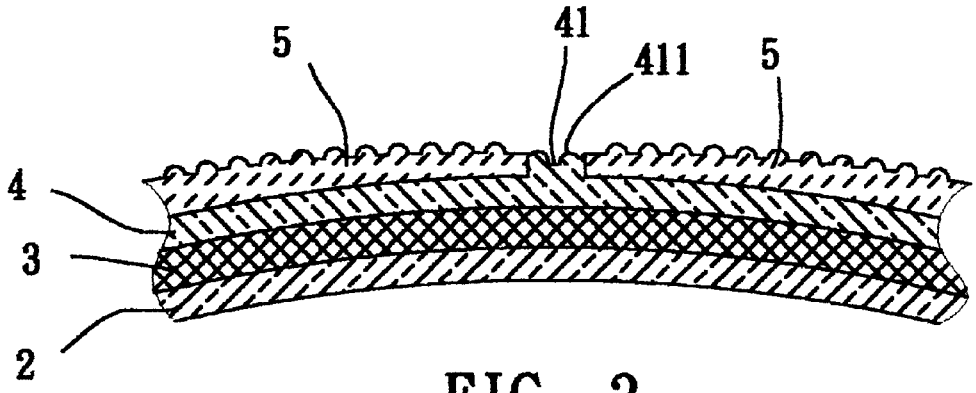
FIG. 3 is a sectional view showing the structure of a laminated basketball according to the present invention.
Figure 2:
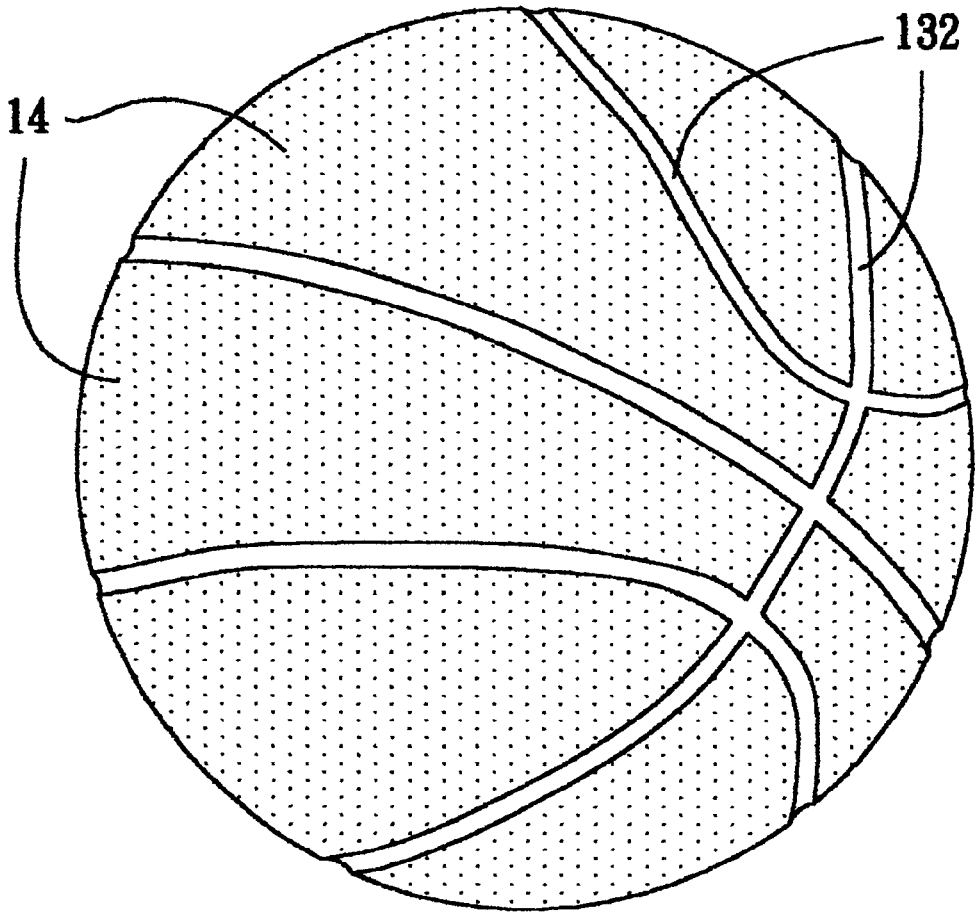
FIG. 2 illustrates the outer appearance of the laminated basketball according to the prior art.

Referring to FIG. 3, a laminated basketball constructed in accordance with the present invention comprises an inflatable inner tube 2, a thread layer 3 wound round the outside wall of the inflatable inner tube 2, a carcass 4 covering the thread layer 3, and a leather cover 5 covering the carcass 4. The leather cover 5 has grained outer surface.

The features of the invention are outlined hereinafter. The carcass 4 comprises a plurality of longitudinally grooved partition ribs 41 formed integral with the outside wall thereof. The leather cover 5 is comprised of multiple panels adhered to the outside wall of the carcass 4 and respectively abutted against each of the respectively longitudinally grooved partition ribs 41. Each longitudinally grooved partition rib 41 has protruding grains 411 disposed flush with the protruding grains of the grained outside wall of the leather cover 5. Because the partition ribs 41 have protruding grains 411 disposed flush with the protruding grained outside wall of the leather cover 5, the basketball does not slip from the hand the user is playing the basketball.

A prototype of basketball has been constructed with the features of FIG. 3. The basketball functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A basketball comprising an inflatable inner tube, a thread layer wound round said inflatable inner tube, a carcass, said carcass having an inner surface adhered to said thread layer and an outer surface, and panels of leather cover adhered to the outer surface of said carcass, said leather cover having grains protruded from an outer surface thereof, wherein said carcass comprises a plurality of longitudinally grooved partition ribs formed integral with the outer surface thereof, said longitudinally grooved partition ribs each having protruding grains disposed flush with the protruding grains of said panels of leather cover; said panels of leather cover are respectively adhered to the outer surface of said carcass and respectively abutted against each of said longitudinally grooved partition ribs.

* * * * *